United States Patent [19]

Piper

[11] Patent Number: 4,527,135

[45] Date of Patent: Jul. 2, 1985

[54] WOVEN CONTROLLED BALANCED TRANSMISSION LINE

[75] Inventor: Douglas E. Piper, Greenville, S.C.

[73] Assignee: Woven Electronics Corp., Mauldin, S.C.

[21] Appl. No.: 506,112

[22] Filed: Jun. 20, 1983

[51] Int. Cl.[3] ..... H01P 3/02

[52] U.S. Cl. ..... 333/5; 174/32; 174/117 M; 139/425 R; 333/236; 333/243

[58] Field of Search ..... 333/1, 4, 5, 12, 236, 333/243; 174/117 M, 32; 139/425 R

[56] References Cited

U.S. PATENT DOCUMENTS

| | | | |
|---|---|---|---|
| 3,447,120 | 5/1969 | Rask et al. | 333/1 X |
| 3,761,842 | 9/1973 | Gandrud | 333/1 |
| 4,143,236 | 3/1979 | Ross et al. | 174/117 M X |

*Primary Examiner*—Paul Gensler
*Attorney, Agent, or Firm*—Cort Flint

[57] ABSTRACT

A balanced-line transmission cable is disclosed for use in a communications system of the type having a differential driver which transmits a differential output in the form of two output voltage signals which are transmitted to two corresponding inputs of a differential receiver which produces an output proportional to the difference between the two input voltage signals. A woven balanced line transmission cable includes a plurality of balanced-line signal conductor pairs each pair consisting of first and second signal transmission wires laterally spaced closely adjacent one another and lying generally parallel with one another in the cable. The first and second signal transmission wires transmit one each of the two voltages for input into the differential receiver. A plurality of fiber warp and weft yarns are interwoven in the cable with the signal conductor wire pairs fixing the lateral spacing and parallel alignment of the first and second signal transmission wires. The first and second signal transmission wires are woven in parallel vertical planes to yield a desired vertical displacement relative to one another in the cable providing a desired impedance value. A ground conductor wire is woven in the cable in the lateral space between the signal conductor wire pairs across the width of the cable.

12 Claims, 7 Drawing Figures

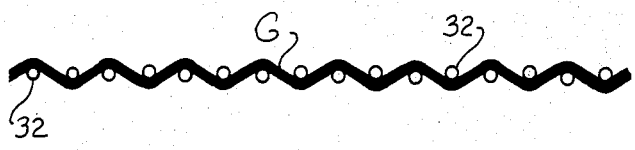
Fig. 4.
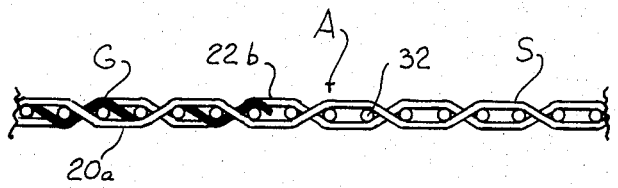
Fig. 5.
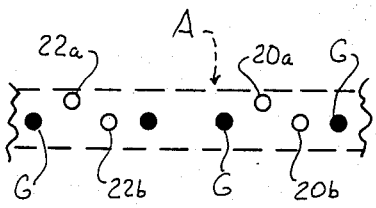
Fig. 6-A
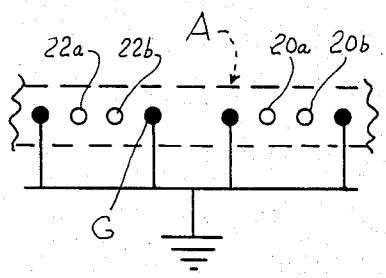
Fig. 6-B.

WOVEN CONTROLLED BALANCED TRANSMISSION LINE

BACKGROUND OF THE INVENTION

In many processing and communication systems, two balanced voltage signals are utilized to produce a single output signal. The balanced voltage signals are transmitted to a differential receiver or amplifier whose output is proportional to the difference between the two input voltage signals. Typically, twisted pairs of signal wires have been utilized to transmit the balanced differential signals. In this manner, if noise is introduced into the balanced signals, the noise affects the two signals of the wires of the pairs in proportional amounts and the difference remains the same so that the output signal is unchanged.

Heretofore, twisted pairs of insulated conductor wires have been woven in flat cable form to provide balanced transmission lines. By twisting associated wires together in pairs their impedance is sought to be controlled. However, the impedance of such a cable is difficult to control. The impedance varies with the spacing of the wires in each twisted pair which is a function of the uniformity and thickness of the insulation surrounding the wire. In the extruding of these wires it is difficult to keep the wire centered in the insulation so that variances occur in the thickness of the insulation and wire-to-wire spacing in the twisted pairs. Furthermore, the impedance is affected by the number of twists per unit length which is difficult to control. The wires also vary in stiffness along their length which causes the wires not to lay as close to each other in the stiff areas further varying the wire-to-wire spacing and affecting impedance values.

Laminated twisted pairs of wire are also utilized in balanced line transmission cables such as shown in U.S. Pat. No. 4,359,597. Twisted sections alternate with straight sections in the cable whereby the cable may be cut in the straight section for terminating the cable. A problem occurs in that these cables must be made in extremely wide widths due to the parallel arrangement of all the untwisted wires in the straight section. Another disadvantage of a laminated twisted pair of cables is that the flat sections are not a controlled impedance section and spurious noises are introduced from one signal pair to the other signal pair.

Accordingly, an important object of the present invention is to provide a balanced transmission line cable having an accurately controlled impedance.

Another important object of the present invention is to provide a balanced line transmission cable which is more reliable and more compact than previous balanced line transmission pairs which have consisted of twisted pairs in either a laminated or woven construction.

Another important object of the present invention is to provide a balanced transmission line which has a lower level of radio frequency emissions than conventional twisted pair cables.

Yet another important object of the present invention is to provide a balanced transmission cable in which the signals are protected from external ground planes.

SUMMARY OF THE INVENTION

The above objectives are accomplished according to the present invention by a generally flat woven cable in which a pair of differential drive signal wires are woven adjacent one another for transmitting a pair of differential voltage signals which are vertically spaced in the woven pattern to fix the impedance of the pair of wires. A ground wire extends on each side of the pair of balanced transmission wires to offset ground plane interference. The balanced transmission wires may be woven in opposite undulations approximately 180 degrees out of phase to provide for higher impedance values without giving up signal wire density in the cable.

BRIEF DESCRIPTION OF THE DRAWINGS

The construction designed to carry out the invention will be hereinafter described together with other features thereof.

The invention will be more readily understood from a reading of the following specification and by reference to the accompanying drawings forming a part thereof, wherein an example of the invention is shown and wherein:

FIG. 4 is a sectional view taken along line 4—4 of FIG. 3;

FIG. 5 is a sectional view taken along line 5—5 of FIG. 3;

FIG. 6A is a sectional view taken along 6A—6A of FIG. 3; and

FIG. 6B is a sectional view taken along line 6B—6B of FIG. 3.

DESCRIPTION OF A PREFERRED EMBODIMENT

Figure 1:
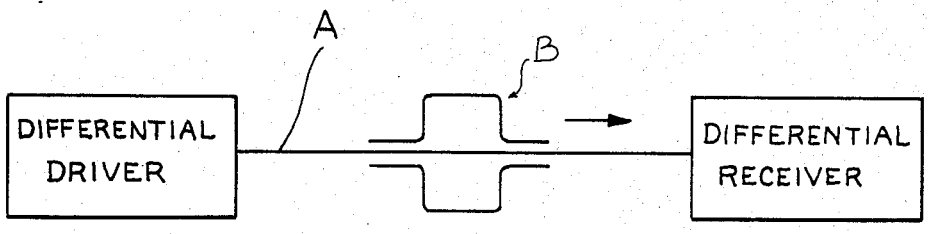
FIG. 1 is a schematic illustration illustrating a differential driver and differential receiver connected together by means of a balanced transmission line A constructed in accordance with the present invention.
Figure 2:
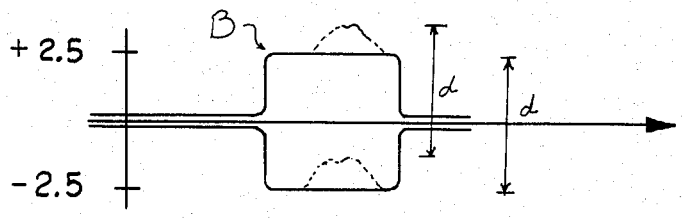
FIG. 2 is a schematic illustration of the voltage signal applied to the two inputs of the differential receiver of FIG. 1 whose output is in proportion to the difference between the voltages.
Figure 3:
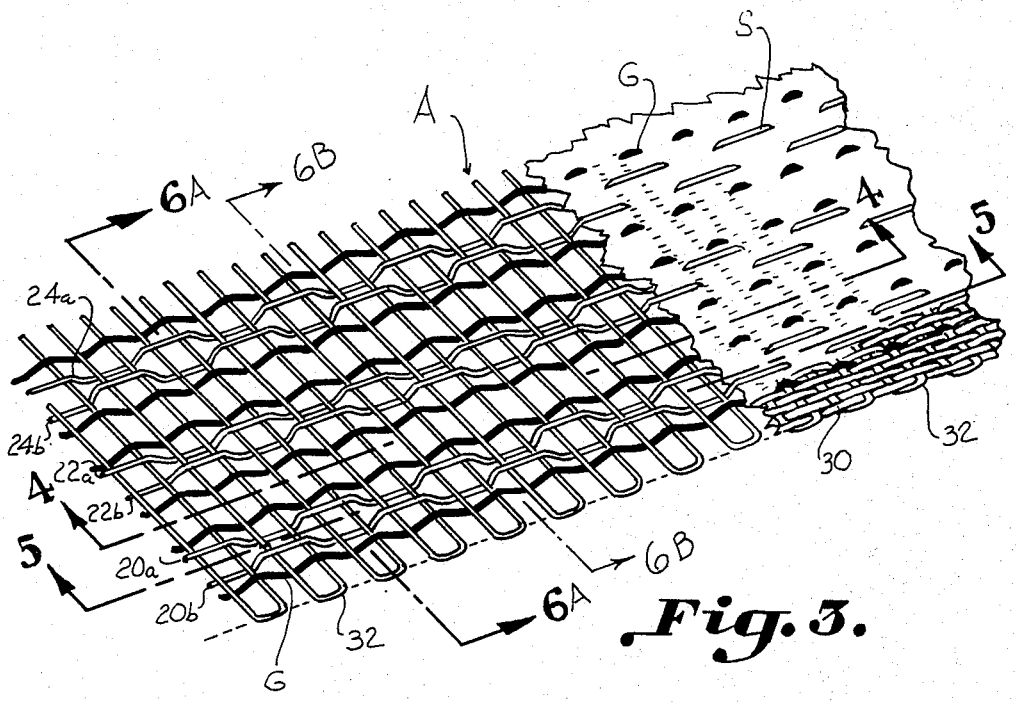
FIG. 3 is a partial perspective view of a woven balanced line transmission cable constructed according to the present invention with parts of the woven fabric omitted for purposes of clarity.

The invention relates to an electrical signal transmission cable and more particularly to a balanced line transmission cable for transmitting balanced differential voltage signals, designated generally as B, in pairs between pairs of corresponding output and input terminals of a differential driver 10 and receiver 12 in an information or processing system such as a computer. In such applications, a balanced line differential system is utilized such that the output of the system is proportional to the difference, d, between two signals which are transmitted along a pair of signal wires which are associated with each other. Groupings of the pairs of associated wires are then provided in the cable with each pair providing a single output signal by processing the two different signals. The balanced signals transmitted along each pair of wires are of equal amplitude but opposite polarity. Any noises introduced into the system from external sources then affect each balanced signal in the pair in the same way such that the resulting output signal is still proportional to the difference d between the two signals. In this manner, outside interference noises are compensated for and eliminated.

Referring now in more detail to the drawings, a woven balanced line transmission cable, designated generally as A, is illustrated which includes a plurality of elongated signal conductor wires S extending longitudinally in a warp direction in the cable. The signal conductor wires are arranged in balanced signal wire pairs 20, 22, and 24, as illustrated. It is to be understood of course that any number of signal wire pairs may be provided in the woven embodiment of the invention and that only a limited number are illustrated for purposes of understanding the invention. Each balanced conductor pair consists of a first signal conductor wire 20*a*, 22*a*, and 24*a*, and a second associated signal conductor wire 20*b*, 22*b*, and 24*b*. The first and second signal wires in each pair are disposed in generally parallel vertical planes in a generally side-by-side manner. As will be more fully explained hereinafter, the vertical displacement between the two signal wires may be varied to provide a desired spacing and impedance value.

There is a ground conductor wire G on each side of each conductor wire pair. This may be provided by either a single ground wire between each pair or double ground wires between each pair, as illustrated. The ground wires serve to minimize the affects of exterior ground planes when the cable is brought close to such a plane such as against the chasis of the computer, etc. The ground wires already maintain a ground on the cable such that when the ground plane is brought in close proximity to the cable, the signals are already adjusted to a ground level and the additional ground plane produces little or no affect on the cable and signals transmitted thereby.

In the woven construction of the cable, a plurality of warp yarns 30 and weft yarns 32 are interwoven in a suitable pattern with the signal conductor wires S and ground wires G to fix their configuration in the cable such that the spacing of the conductors is precisely fixed. The warp and weft yarns may be interwoven in any suitable pattern such as a plain weave wherein the ground wires G and the warps and weft yarns are woven together in a one up and one down pattern to form the plain weave. The signal conductor wires are woven in a two-over, two-under pattern in the plain weave. The signal conductors S of each pair are illustrated as being woven in an undulating pattern wherein the undulations are 180 degrees out of phase.

The phase shift of the undulations, and thus the vertical displacement of the signal conductor wires in each pair may be varied with respect to each other as desired to provide a desired impedance value. With the undulations 180 degrees out of phase, a maximum relative displacement and impedance will be provided for the cable for a given lateral spacing of the conductor wires and signal density of the cable. The undulations may be woven less out of phase to lower the impedance value as desired. The lateral spacing of the signal conductor wires in each pair may also be varied to effect a desired impedance value and the positioning fixed in the cable by means of the woven yarns. In this manner, a highly precisely controlled impedance may be had for the cable.

It will be noted that the undulations of the first signal wires 20*a*, 22*a*, 24*a* of adjacent balanced signal line pairs are in phase with one another as are the second signal wires 20*b*, 22*b*, 24*b* of each pair.

The construction permits maximum signal density within a given cable width since impedance is determined by vertical displacement rather than solely lateral displacement in conventional cables. That is, since the lateral dimension of the cable is not needed for spacing of the signals for higher impedance values, more signal wires may be incorporated into the cable width.

It will also be noted that the spacing between first and second single wires in each balanced-line pair is less than the spacing of balanced-line pairs for association and delineation, and isolation to the extent allowed.

While a preferred embodiment of the invention has been described using specific terms, such description is for illustrative purposes only, and it is to be understood that changes and variations may be made without departing from the spirit or scope of the following claims.

What is claimed is:

1. A woven balanced-line transmission cable for transmitting split differential voltage signals from a differential driver to a differential receiver comprising:

a plurality of elongated signal conductor wires extending longitudinally in a warp direction in said cable;

said signal conductor wires arranged in balanced-line signal wire pairs consisting of first and second signal wires for connection to an output of said differential driver for transmitting a split balanced signal consisting of first and second signals of equal amplitude and opposite polarity and for connection to an input of said differential receiver providing an input signal thereto representative of the difference between said first and second signals;

said first and second balanced-line signal wires disposed parallel to one another and generally side-by-side one another in laterally spaced vertical planes;

said first and second signal wires having a desired vertical displacement relative to each other in said vertical planes;

a ground conductor wire between each balanced-line signal wire pair minimizing the affects of exterior ground planes; and warp and weft fiber yarns woven in the warp and weft directions with one another and said signal and ground conductor wires to fix the position of said conductor wires in said cable.

2. The cable of claim 1 wherein said first and second signal conductor wires of each balanced pair undulate relative to each other out of phase.

3. The cable of claim 1 wherein said first and second signal wires of each balanced pair are woven with said warp and weft yarns of said cable in undulations approximately 180 degrees out of phase with one another.

4. The cable of claim 2 or 3 where said first conductor wires of adjacent balanced-line signal pairs are woven in undulations in phase with one another and said second conductor wires of said balanced-line signal pairs are woven in phase with one another.

5. A method of constructing a woven balanced-line electrical transmission cable for transmitting differential voltage signals to a differential receiver comprising:

providing a plurality of elongated conductor wires;

weaving said conductor wires with warp and weft fiber yarns to fix the position and configuration of said conductor wires in said cable;

selecting a first plurality of said conductor wires as balanced wire pairs consisting of first and second signal conductor wires transmitting first and second signals of equal amplitude and opposite polarity for providing an output signal at said differential receiver proportional to the difference of said first and second signals;

weaving said first and second signal conductor wires of each balanced-line pair in parallel vertical planes with a predetermined vertical displacement between said first and second signal wires wherein said position of said signal conductors is precisely fixed in said woven pattern to set the impedance of said wires at a desired value;

weaving said first and second signal conductor wires of each balanced pair generally side-by-side one another spaced in close proximity;

weaving said balanced pairs spaced apart in said cable with more spacing between said pairs than between said first and second signal conductor wires in each pair;

selecting a second plurality of said conductor wires as ground conductor wires and weaving at least one ground conductor wire between each said balanced pair minimizing interference from external ground sources; and weaving said warp and weft yarns, signal conductors, and ground conductors to make a cable of a desired length.

6. The method of claim 5 including weaving said first and second signal conductor wires in an undulating configuration out of phase with one another in said vertical planes to yield a desired impedance.

7. The method of claim 5 including weaving said first and second signal conductor wires in an undulating configuration in said vertical planes wherein said first and second wires are approximately one-hundred and eighty degrees out of phase.

8. The method of claim 5 including weaving first and second signal conductor wires in an undulating configuration in said cable wherein first signal conductor wires of adjacent pairs are in phase with one another and second signal conductor wires of adjacent balanced pairs are in phase with one another.

9. The method of claims 5 or 7 including weaving said first signal conductor wires of adjacent balanced pairs in phase with one another and said second signal conductor wires of adjacent balanced pairs in phase with one another.

10. In a communications system of the type having a differential drive which transmits a differential output in the split form two output voltages whose difference is proportional to the differential output and a differential receiver for receiving the two voltage outputs transmitted from said differential drive to produce an output proportional to the difference between said two voltage signals, a woven balanced line transmission cable for transmitting the voltage signals between the differential driver and differential receiver comprising:

a plurality of balanced-line signal conductor wire pairs each pair consisting of a first signal transmission wire and a second signal transmission wire laterally spaced closely adjacent one another and lying generally parallel with one another in said cable;

said first and second signal transmission wires adapted for receiving one each of said two voltages for transmitting said differential output in the form of said two different voltages to said differential receiver;

a plurality of fiber warp and weft yarns interwoven in said cable with said signal conductor wire pairs fixing said lateral spacing therebetween; and fixing said lateral spacing and parallel alignment of said first and second signal transmission wires;

said first and second signal transmission wires being woven in parallel vertical planes to have a desired vertical displacement relative to one another in said cable providing a desired impedance value; and a ground conductor wire woven in said cable in said lateral space between said signal conductor wire pairs across the width of said cable.

11. The system of claim 10 wherein said first and second signal conductor wires are woven in an undulating configuration, the undulations of which are out of phase with one another to provide said desired vertical displacement and impedance.

12. The system of claim 11 wherein first and second signal transmission wires are woven in phase with corresponding first and second signal transmission wires of adjacent signal conductor wire pairs.

* * * * *